US009130254B1

(12) United States Patent
Izadian

(10) Patent No.: US 9,130,254 B1
(45) **Date of Patent: *Sep. 8, 2015**

(54) PRINTED WAVEGUIDE TRANSMISSION LINE HAVING LAYERS BONDED BY CONDUCTING AND NON-CONDUCTING ADHESIVES

(71) Applicant: Google Inc., Mountain View, CA (US)

(72) Inventor: Jamal S. Izadian, San Jose, CA (US)

(73) Assignee: Google Inc., Mountain View, CA (US)

( * ) Notice: Subject to any disclaimer, the term of this patent is extended or adjusted under 35 U.S.C. 154(b) by 236 days.

This patent is subject to a terminal disclaimer.

(21) Appl. No.: 13/851,469

(22) Filed: Mar. 27, 2013

(51) Int. Cl.
*H01P 3/18* (2006.01)
*H01P 11/00* (2006.01)

(52) U.S. Cl.
CPC ..... *H01P 3/18* (2013.01); *H01P 11/001* (2013.01)

(58) Field of Classification Search
CPC ..... H01P 3/121; H01P 3/18; H01P 3/165; H01P 1/12
USPC ..... 333/239, 248
See application file for complete search history.

(56) References Cited

U.S. PATENT DOCUMENTS

| | | | | |
|---|---|---|---|---|
| 3,854,083 | A | 12/1974 | Hulderman et al. | |
| 4,918,411 | A * | 4/1990 | Staehlin et al. | 333/239 |
| 5,977,924 | A | 11/1999 | Takei | |
| 5,982,256 | A * | 11/1999 | Uchimura et al. | 333/239 |
| 6,285,335 | B1 | 9/2001 | Snygg | |
| 6,822,534 | B2 | 11/2004 | Uriu | |
| 7,215,007 | B2 | 5/2007 | McKinzie, III | |
| 7,227,428 | B2 | 6/2007 | Fukunaga | |
| 8,040,286 | B2 | 10/2011 | Matsuo | |
| 8,188,805 | B2 | 5/2012 | Nomura | |
| 8,212,580 | B2 | 7/2012 | Izadian | |
| 2007/0262828 | A1 * | 11/2007 | Fujita | 333/26 |
| 2008/0150821 | A1 | 6/2008 | Koch | |
| 2008/0169349 | A1 | 7/2008 | Suzuki | |

(Continued)

FOREIGN PATENT DOCUMENTS

| | | |
|---|---|---|
| JP | 2001156510 | 6/2001 |
| WO | 2009023551 A1 | 2/2009 |

OTHER PUBLICATIONS

U.S. Appl. No. 13/854,190, Non—Final Office Action mailed Dec. 29, 2014.

(Continued)

*Primary Examiner* — Benny Lee
(74) *Attorney, Agent, or Firm* — McDonnell Boehnen Hulbert & Berghoff LLP

(57) ABSTRACT

Three-dimensional electromagnetic signal interconnect systems and methods for fabricating the interconnect systems are described. An example apparatus may comprise a first layer including a first dielectric layer coupled to one or more of a first and second conducting layer. The first layer may also include at least one hole. The apparatus may also comprise a second layer including at least one through-hole and a second dielectric layer coupled between a third and fourth conducting layer. The apparatus may further comprise a third layer including at least one hole and a third dielectric layer coupled to one or more of a fifth and sixth conducting layer. The at least one hole/through-hole of each layer may be aligned at least in part with the at least one hole/through-hole of each other layer, and may include metal plating coupled to an inner surface of the respective at least one hole/through-hole.

18 Claims, 5 Drawing Sheets

(56) References Cited

U.S. PATENT DOCUMENTS

| | | | | |
|---|---|---|---|---|
| 2009/0309680 | A1* | 12/2009 | Suzuki | 333/254 |
| 2010/0307798 | A1 | 12/2010 | Izadian | |
| 2011/0001584 | A1 | 1/2011 | Enokihara | |
| 2011/0018657 | A1 | 1/2011 | Cheng | |
| 2012/0050125 | A1 | 3/2012 | Leiba | |
| 2012/0056776 | A1 | 3/2012 | Shijo | |
| 2012/0306598 | A1 | 12/2012 | Izadian | |

OTHER PUBLICATIONS

U.S. Appl. No. 13/852,416, Non—Final Office Action mailed Jan. 14, 2015.

* cited by examiner

PRINTED WAVEGUIDE TRANSMISSION LINE HAVING LAYERS BONDED BY CONDUCTING AND NON-CONDUCTING ADHESIVES

BACKGROUND

In communications and electronic engineering, a transmission line is a specialized cable designed to carry alternating current of radio frequency, that is, current with a frequency high enough that their wave nature are taken into account. Transmission lines are used for purposes such as connecting radio transmitter and receivers with their antennas, distributing cable television signals, and computer network connections. Transmission lines use techniques, such as precise conductor dimensions and spacing, and impedance matching, to carry electromagnetic signals with minimal reflections and power losses. Types of transmission lines include twin-lead cables, coaxial cables, striplines, optical fibers, and waveguides, for example.

SUMMARY

In one aspect, an apparatus is described. The apparatus may comprise a first layer comprising at least one first conducting layer coupled to a first dielectric layer. The apparatus may also comprise a second layer coupled to the first layer and comprising a second dielectric layer coupled between a second conducting layer and a third conducting layer, and the second layer may include at least one through-hole. The apparatus may further comprise a third layer coupled to the second layer and comprising a third dielectric layer coupled between a fourth conducting layer and a fifth conducting layer, and the third layer may include at least one through-hole aligned at least in part with the at least one through-hole of the second layer. The apparatus may still further comprise a fourth layer coupled to the third layer and comprising a fourth dielectric layer coupled between a sixth conducting layer and a seventh conducting layer, and the fourth layer may include at least one through-hole aligned at least in part with the at least one through-holes of the second and third layers. The apparatus may yet still further comprise a fifth layer coupled to the fourth layer and comprising a fifth dielectric coupled between an eighth conducting layer and a ninth conducting layer, and the fifth layer may include at least one through-hole aligned at least in part with the at least one through-holes of the second, third, and fourth layers.

In another aspect, a method is described. The method may comprise forming at least one waveguide channel of a first shape in a first layer, and the first layer may include a first dielectric layer coupled to one or more of a first conducting layer and a second conducting layer. The method may also comprise forming at least one waveguide channel of a second shape in a second layer, and the second layer may include a second dielectric layer coupled between a third conducting layer and a fourth conducting layer. The method may also comprise providing a first metal plating to an inner surface of the at least one waveguide channel of the second shape. The method may further comprise forming at least one waveguide channel of a third shape in a third layer, and the third layer may include a third dielectric layer coupled to one or more of a fifth conducting layer and a sixth conducting layer. The method may still further comprise providing a second metal plating to an inner surface of the at least one waveguide channel of the third shape. The method may yet still further comprise providing a conducting adhesive to at least edges of the at least one waveguide channel in the second layer, and the conducting adhesive may be configured to couple the second layer between the first layer and the third layer so as to align at least in part the at least one waveguide channel of the second layer with the at least one waveguide channels of the first layer and the third layer.

In yet another aspect, another method is described. The method may comprise forming a first conducting layer including at least one hole. The method may also comprise forming a second conducting layer including at least one hole. The method may further comprise forming a first layer between the first conducting layer and the second conducting layer, and the first layer may include at least one through-hole aligned at least in part with the at least one hole of the first conducting layer and the at least one hole of the second conducting layer. The method may still further comprise forming a third conducting layer including at least one hole. The method may yet still further comprise forming a second layer between the second conducting layer and the third conducting layer, and the second layer may include at least one through-hole aligned at least in part with the at least one hole of the first conducting layer, the at least one hole of the second conducting layer, the at least one through-hole of the first layer, and the at least one hole of the third conducting layer.

The foregoing summary is illustrative only and is not intended to be in any way limiting. These as well as other aspects, advantages, and alternatives, will become apparent to those of ordinary skill in the art by reading the following detailed description, with reference where appropriate to the accompanying drawings.

DETAILED DESCRIPTION

Figure 1:
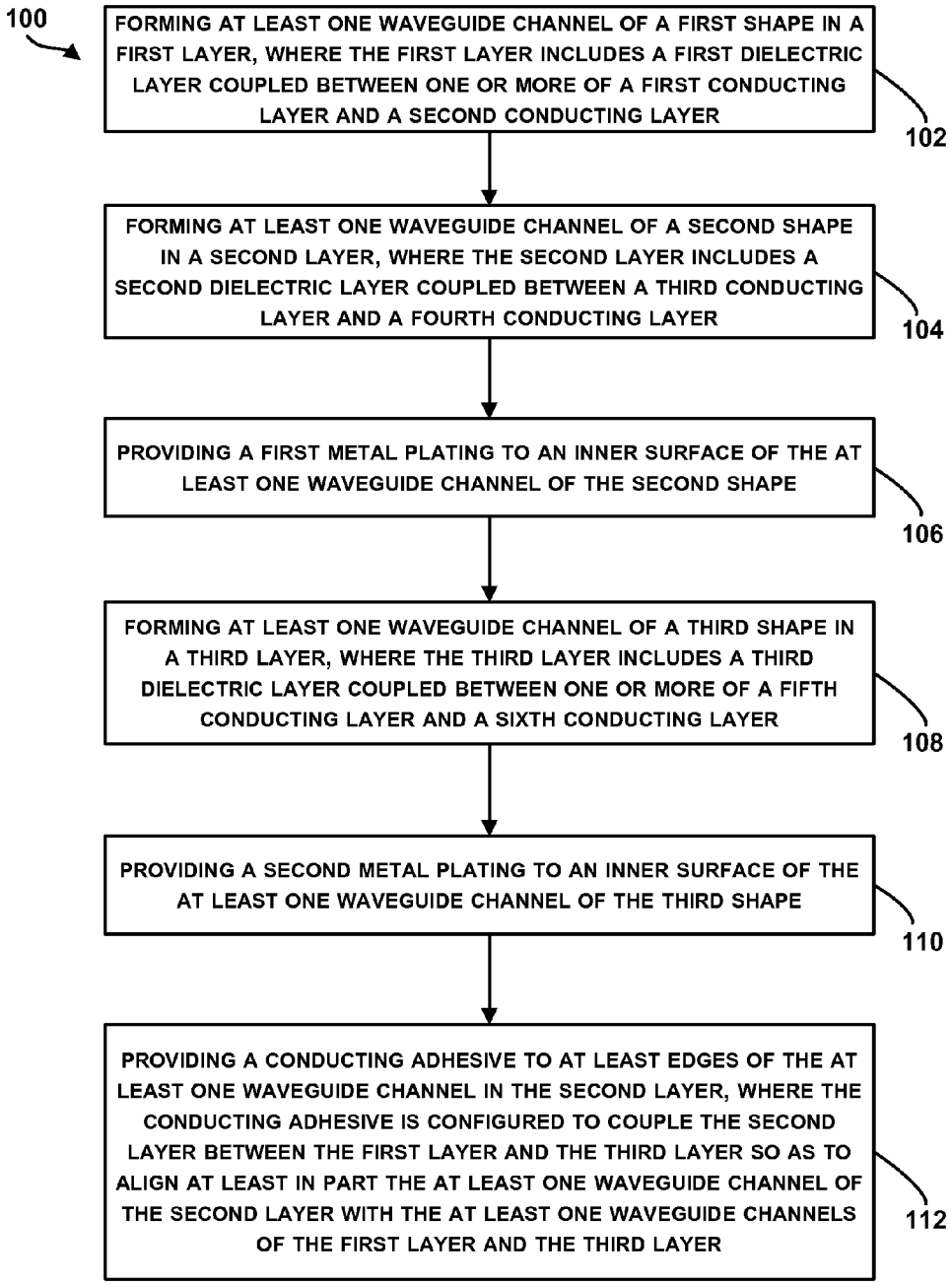
FIG. 1 is a flow chart of a method to form three-dimensional (3D) signal interconnections using Printed Waveguide Transmission Lines (PWTL), in accordance with an example embodiment.

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The following detailed description may disclose, inter alia, methods and apparatuses for a 3D interconnect system utilizing PWTL technology.

Waves in open space propagate in all directions, as spherical waves. In this manner, the waves lose power proportionally to the square of propagation distance; that is, at a distance R from the source, the power is the source power divided by $R^2$. A waveguide is a structure that guides waves, such as electromagnetic waves or sound waves. For instance, the waveguide may confine a wave to propagate in one dimension, so that, under ideal conditions, the wave may lose no power while propagating. There are different types of waveguides for each type of wave. As an example, a waveguide includes a hollow conductive metal pipe used to carry high-frequency radio waves or microwaves. Radio waves and microwaves may be collectively referred to herein as "millimeter waves," as the shortest wavelength of such waves is 1 mm.

Geometry of a waveguide reflects its functions. Slab waveguides, for example, may confine energy to travel in one dimension, while fiber or channel waveguides may confine energy to travel in two dimensions. Waves are confined inside the waveguide due to reflection from walls of the waveguide, so that the propagation inside the waveguide can be described approximately as a "zigzag" between the walls. This description is applicable, for example, to electromagnetic waves in a hollow metal tube with a rectangular or circular cross-section. Frequency of the transmitted wave may also dictate the shape of a waveguide. As an example, an optical fiber guiding high-frequency light may not guide microwaves of a much lower frequency. Generally, width of a given waveguide may be of the same order of magnitude as a respective wavelength of the guided wave.

Waveguide transmission line technology can be used for transferring both power and communication signals, and may be implemented in radar systems, microwave ovens, satellite communications, high speed routers and cabling, and antenna systems, among others. With regard to antenna systems, in particular, waveguide transmission lines enable electromagnetic waves such as radio frequency waves to be received at and transmitted from antennas.

Waveguides can be constructed to carry waves over a wide portion of the electromagnetic spectrum, such as in the microwave and optical frequency ranges. Depending on the frequency, the waveguides can be constructed from either conductive or dielectric materials. Some waveguide transmission lines may be manufactured by machining solid blocks of metal with channels in which the radio waves may travel. Additionally or alternatively, waveguide transmission lines may be manufactured using high-quality dielectric laminates, such as high-quality radio frequency laminates for waveguide transmission lines used for radio wave communications. Such laminates may comprise conducting material (e.g., copper) electrodeposited in one or more surfaces of the laminate, and may further comprise additional conducting layers (e.g., copper, aluminum, and/or brass foils/plates).

In some examples, waveguides may include printed waveguide transmission lines (PWTLs) that may comprise a multi-layer laminated structure including printed electronics, such as printed circuit boards (PCBs) comprising a dielectric material with an conducting material imaged (i.e., "printed") and deposited in the dielectric material. One embodiment of a PWTL may include rectangular channels formed in the multi-layer structure and configured to transmit/propagate transverse electric ($TE_{mn}$) waves, where m is a number of half-wavelengths across a width of the rectangular channel and n is the number of half-wavelengths across the height of the rectangular channel. In other examples, multi-layer PWTLs may include sheet metals and foils.

PWTLs, among other waveguide technologies, may provide precision in facilitating the propagation of radar wave signals in the radio frequency range (e.g., 77 GHz wave signals) with low energy/power losses, such as radiation loss, resistive loss, dielectric loss, or the like. In particular, PWTL technology may have no dielectric losses due to the wave energy travelling in air through the waveguide channels. Further, factors such as conductive loss, surface roughness of the channel walls, and wave reflections off the channel walls may contribute to energy losses. In general, performance of a PWTL (including, but not limited to, the range of frequencies supported by the PWTL and the reduction of losses by the PWTL) may be commensurate with accuracy and precision of the manufacturing of the PWTL.

FIG. 1 is a flow chart of a method 100 to form three-dimensional (3D) signal interconnections using a PWTL. The PWTL, such as that described by the method 100, may be fabricated using components such as conducting layers (e.g., sheet metals of various thicknesses), dielectric laminate layers, and/or other layers of various materials. It should be understood that other methods of fabrication are also possible.

The method 100 may include one or more operations, functions, or actions as illustrated by one or more of blocks 102, 104, 106, 108, 110, and 112. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

At block 102, the method 100 includes forming at least one waveguide channel of a first shape in a first layer. The at least one waveguide channel (and each waveguide channel if more than one are formed) may include either a through-hole or a blind-hole, which may be formed by drilling, reaming, etching, or otherwise machining the first layer. In some examples, the waveguide channel may include a blind-hole, and the blind-hole may be configured so as to enable the first layer to allow for wave propagation through the waveguide channel of the first layer and to radiate millimeter electromagnetic waves through a blind end of the waveguide channel of the first layer. For instance, the first layer may include an antenna screen element configured to radiate millimeter electromagnetic waves, and the antenna screen element may include the through-hole or blind-hole.

The first layer may include a first dielectric layer, which may be coupled between a first conducting layer and a second conducting layer. The conducting layers may vary in thickness, and may include a foil or other sheet metal. Further, the conducting layers may include copper, aluminum, or any other conducting materials. For instance, the first dielectric layer may include a polyimide film, such as Kapton™, and the first dielectric layer coupled to the conducting layer(s) may include a polyimide copper laminate, of which a conducting copper layer may be coupled to one or both sides/surfaces of the first dielectric layer.

In some examples, the first layer may include Kapton coupled to one conducting copper layer. In such examples, the waveguide channel may be formed in the conducting copper layer and may include a blind-hole formed through the copper layer without breaking through the Kapton. Alternatively, the waveguide channel may include a through-hole formed through both the Kapton and the copper layer. In other examples, the first layer may include Kapton coupled between two conducting copper layers, and a through-hole or blind-hole may be formed in/through the first layer. In still other examples, and regarding other methods of fabrication, the first layer may not include a first dielectric layer, and may only include one conducting layer. As such, the first layer comprising only a conducting layer may include a through-hole (or blind-hole) configured to enable the first layer to radiate millimeter electromagnetic waves. Other examples are also possible.

In the examples just described, as well as in other possible examples, it should be understood that the first layer (including the first dielectric layer and the one or more conducting layers) may be configured to enable the PWTL to radiate electromagnetic millimeter waves through the through-hole or blind-hole. Alternatively, the first layer may include one or more through-holes configured to function as a "coupling channels" which may enable waves to propagate through the coupling channel and into another identical or different waveguide structure. For instance, in some embodiments, multiple PWTL structures (each including the first layer) may be coupled together so as to form a longer waveguide transmission line, and the first layer may function as a coupling channel between PWTL structures. In such embodiments, a conducting material (e.g., a metallic material) may be deposited or plated on an inner surface of the through-hole of the first dielectric layer since the inner surface of the first dielectric layer may not be conducting surfaces capable of propagating electromagnetic waves. Plating the inner surface(s) of the through-hole(s) may allow millimeter waves to travel through the coupling channel. Other embodiments are also possible.

Figure 2A:
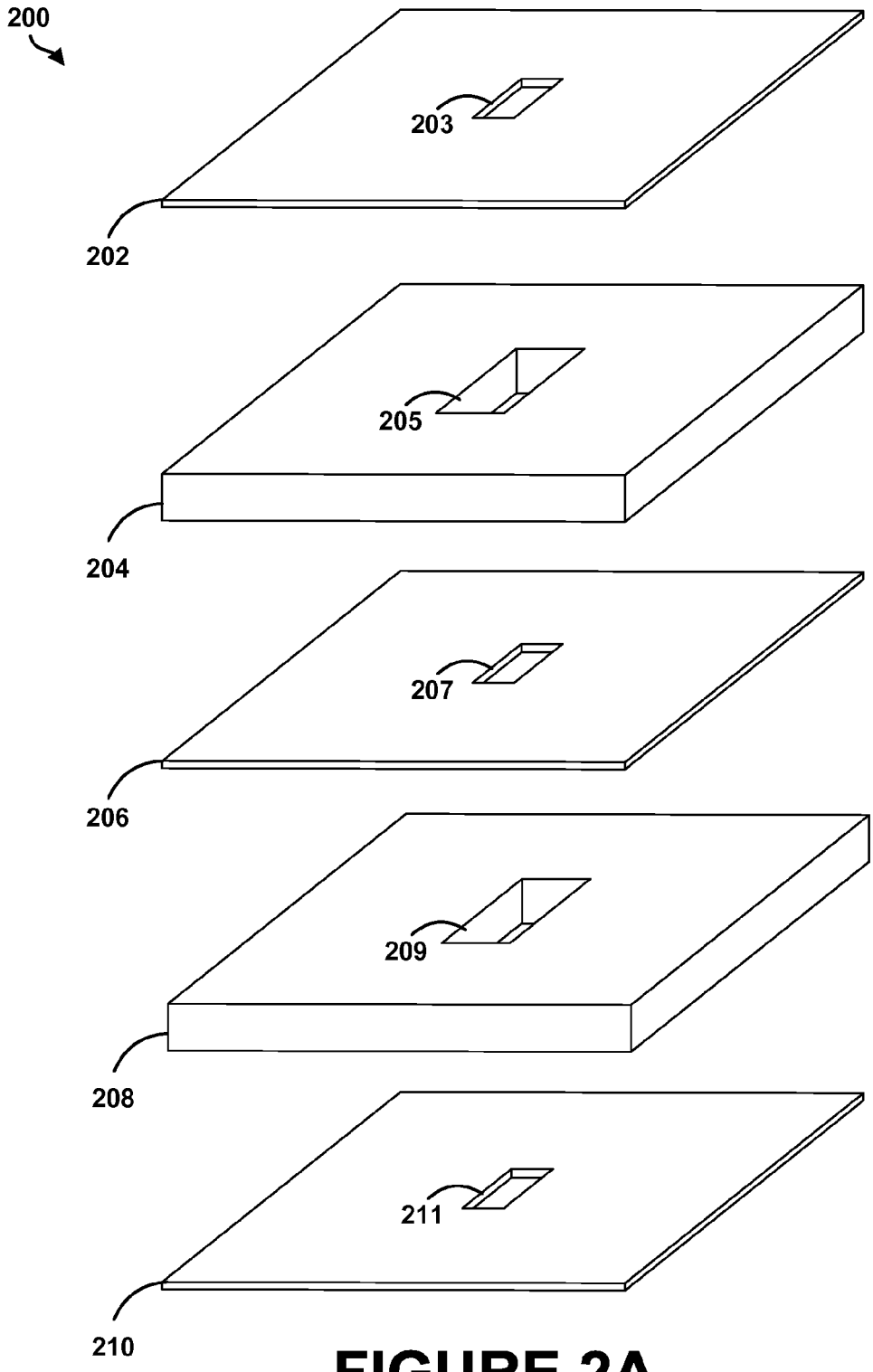
FIG. 2A illustrates an exploded view of different layers of an example apparatus.

FIG. 2A illustrates an exploded view of different layers of an example PWTL apparatus 200. The apparatus 200 may include a first layer 202, and the first layer 202 may include a through-hole 203, as shown. It should be understood, however, that the through-hole 203 shown is an example for illustration and that the first layer 202, as well as other layers described herein, may each include more than one through-hole, blind-hole, or other such hole formed in the layer as a waveguide channel. Further, the first layer 202 may include a conducting layer coupled to one surface of a first dielectric layer, and may further include another conducting layer coupled to an opposite surface of the first dielectric layer. The through-hole 203 may be drilled, reamed, etched, or formed using any other manufacturing technique appropriate for the material of the first dielectric layer and any conducting layers coupled to the first dielectric layer.

Referring back to FIG. 1, at block 104, the method 100 includes forming at least one waveguide channel of a second shape in a second layer, and the second layer may include a second dielectric layer coupled between a third conducting layer and a fourth conducting layer. Each of the at least one waveguide channels in the second layer may include a through-hole, although in some examples, one or more of the at least one waveguide channels in the second layer may include a blind-hole. The through-hole(s) may be formed by drilling, reaming, etching, or otherwise machining the second layer. In some examples, the second dielectric layer may be thicker than the first dielectric layer.

As shown in FIG. 2A, the second layer 204 may be located underneath the first layer 202, and may include a through-hole 205 of a similar or different shape/size as the waveguide channel (e.g., through-hole 203) of the first layer 202. The second layer 204 may be made of a dielectric material (e.g., the second dielectric layer) that is laminated with conducting layers (e.g., the third and fourth conducting layers) on both sides.

For instance, the second dielectric layer may include FR-4 material. FR-4 is a grade designation assigned to glass-reinforced epoxy laminate sheets, tubes, or rods, and FR-4 is a composite material composed of woven fiberglass cloth with an epoxy resin binder that is flame resistant (self-extinguishing). FR-4 glass epoxy is a versatile high-pressure thermoset plastic laminate grade used as an electrical insulator possessing considerable mechanical strength. The FR-4 material may be configured to retain high mechanical values and electrical insulating qualities in both dry and humid conditions. FR-4 epoxy resin may include bromine, a halogen, to facilitate flame-resistant properties in FR-4 glass epoxy laminates.

In some examples, the second dielectric layer may include additional conducting layers coupled to one or both sides of the second dielectric layer. For instance, the second dielectric layer may be made of FR-4 material, which may be laminated or metallized with conducting material on both sides (e.g., copper traces etched onto the FR-4 substrate). As such, additional laminates, such as other copper traces or full copper sheets, may be coupled to one or both sides of the second dielectric layer on top of the other laminates. The traces/laminates may be made of other conducting material as well. The traces formed may be similar to circuit-board traces, and such traces may implement electric circuitry and signal routing functionality. In other examples, the second layer 204 may be made of a conducting material, such as any metal (e.g., copper, aluminum, etc.), rather than including a dielectric layer. Other examples are also possible.

Referring back to FIG. 1, at block 106, the method 100 includes providing a first metal plating to an inner surface of the at least one waveguide channel of the second shape. In some examples, a through-hole of the second layer, such as a through-hole formed in the second dielectric layer, may include an inner surface that may not be a conducting surface, but rather the inner surface may be exposed non-conductive dielectric material. In such examples, the inner surface may be metallized so as to enable the through-hole (e.g., waveguide channel) to propagate millimeter waves through the second dielectric layer.

For instance, with respect to FIG. 2A, the second layer 204 may be made of FR-4 material, and the inner surface of the through-hole 205 may be a non-conductive surface of exposed FR-4 dielectric material. As such, a conducting material (e.g., a metallic material) may be deposited or plated on the inner surface of the through-hole 205. The plated through-hole 205 may thus be configured to provide conductive connections between layers, such as between the second layer 204 and the first layer 202, for example.

Several techniques can be used to deposit or plate the inner surfaces of the through-holes with a conducting material. The through-holes may be preconditioned first. For example, several processes such as desmearing, hole conditioning, micro-etching, activation, and acceleration can be applied to precondition the through-holes. The first layer 202 may then be dipped in solution where electroless copper can be deposited on the inner surfaces. Other techniques can be used to deposit or plate a metallic or conducting material on the inner surfaces of the through-holes. For instance, techniques used in printed circuit board (PCB) manufacturing can be used for forming the second layer 204 and depositing a conducting material on the inner surface of the through-hole 205, and on any other respective surfaces of additional through-holes formed in the second layer 204.

Referring back to FIG. 1, at block 108, the method 100 includes forming at least one waveguide channel of a third shape in a third layer, and the third layer may include a third dielectric layer coupled to one or more of a fifth conducting layer and a sixth conducting layer. Similar to the description of the first layer at block 102, the at least one waveguide channel of the third layer may include either a through-hole or a blind-hole, the conducting layer(s) may include copper, aluminum, or any other conducting materials coupled to one or both surfaces of the third dielectric layer, and the third dielectric layer may include a polyimide film, such as Kapton. As shown in FIG. 2A, the third layer 206 may include a through-hole 207.

Further, at block 110, the method 100 includes providing a second metal plating to an inner surface of the at least one waveguide channel of the third shape. Plating the through-hole(s) of the third layer may enable the third layer to function as a coupling channel. For example, as shown in FIG. 2A, the apparatus 200 includes a fourth layer 208 and a fifth layer 210, each with a respective through-hole 209, 211. In the apparatus 200 shown in FIG. 2A, the third layer 206, or rather the through-hole 207 of the third layer 206, may act as a coupling channel with a conductive, plated inner surface to allow for the transmission of millimeter waves from the second layer 204 to the fourth layer 208, or from the fourth layer 208 to the second layer 204.

The fourth layer 208 and the fifth layer 210 shown in FIG. 2A are illustrative of a multi-layer, stacked PWTL. For example, the fourth layer 208 may include a fourth dielectric layer coupled between a sixth conducting layer and a seventh conducting layer. The dielectric material of the fourth dielectric layer may be the same as or different from the dielectric material of the second dielectric layer, and the two conducting layers coupled to outer surfaces of the fourth dielectric layer may be made of copper, aluminum, or other conducting material. The fourth layer 208 may also include additional conducting layers. As another example, the fourth layer 208 may be made of a conducting material and not include any dielectric materials. Thus, no plating of the at least one waveguide channel of the fourth layer 208 may be needed.

The fifth layer 210 may be similar to or different from the first layer 202 and/or the third layer 206. In the example apparatus 200 of FIG. 2A, the through-hole 211 of the fifth layer 210 is shown for illustrative purposes, since other layers (not shown) may be coupled underneath the fifth layer 210 so as to form an extended stacked PWTL, and the through-hole 211 may function as a coupling channel to the other layers. However, the fifth layer 210 may include a blind-hole or may not include a hole. Further, the fifth layer 210 may be made of material not described herein, and/or may include additional electronics, such as a semiconductor chip.

Each through-hole (i.e., waveguide channel) 203, 205, 207, 209, and 211 may include a respective shape and size. In the apparatus 200 shown in FIG. 2A, for example, each of the through-holes of the first, third, and fifth layers 203, 207, 211 are the same size, and are smaller in size compared to the through-holes of the second and fourth layers 205, 209. In other examples, one or more of the waveguide channels may include an angled shape (e.g., non-orthogonal to the respective layer). In still other examples, one or more layers of the apparatus 200 may include a T-shaped waveguide channel of varying size, which may also be used to transmit millimeter waves. Other example sizes and shapes are possible.

Figure 2B:
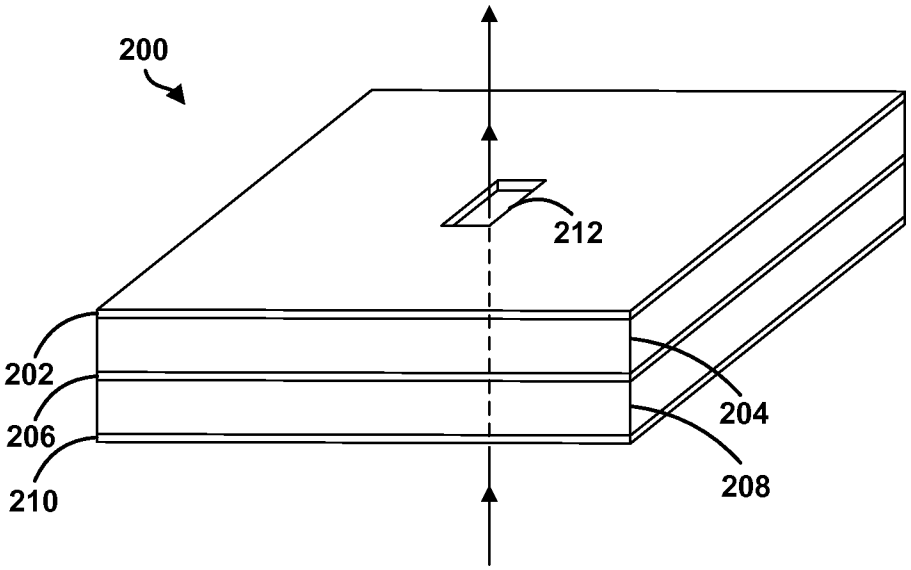
FIG. 2B illustrates an assembled view of the example apparatus.

It should be understood that respective thicknesses of each layer described and illustrated herein may vary with respect to each other. For example, as shown in FIGS. 2A and 2B, the thickness of the second and fourth layers 204, 208 may be greater than the thickness of the first, third, and fifth layers 202, 206, 210. In other examples, the thickness of the second and/or fourth layers may be substantially greater than that of the first, third, and/or fifth layers. Other examples are also possible.

It should also be understood that although vertical transmission of electromagnetic waves is described and illustrated herein, multi-layer PWTLs may be configured to enable electromagnetic waves to propagate horizontally (e.g., from one point to another at the same level/layer), in addition to or alternatively to vertical propagation. For example, waves may be transmitted through a vertically-oriented waveguide channel to a particular layer including a horizontally-oriented waveguide channel, and the waves may then be transmitted through the horizontally-oriented waveguide channel to another horizontally-oriented waveguide channel and/or another vertically-oriented waveguide channel.

Referring back to FIG. 1, at block 112, the method 100 includes providing a conducting adhesive to at least edges of the at least one waveguide channel in the second layer, and the conducting adhesive may be configured to couple the second layer between the first layer and the third layer so as to align at least in part the at least one waveguide channel of the second layer with the at least one waveguide channels of the first layer and the third layer. The conducting adhesive may include solder paste, for example.

The conducting adhesive may be applied to areas surrounding the waveguide channels (through-holes and/or blind-holes) of the first, second, and third layers, so as to at least partially align the waveguide channels with each other and define an electromagnetic wave path through which electromagnetic waves (e.g., millimeter waves) may propagate. In some examples, the conducting adhesive may provide sufficient adhesion for coupling each layer together.

However, in other examples in which the conducting adhesive does not provide sufficient adhesion, an additional thin, non-conducting adhesive layer, such as a prepreg adhesive or double-sided adhesive Kapton tape, may be included between each of the first, second, and third layers. In such other examples, the non-conducting adhesive layer may be applied to an outer surface (e.g., at least a portion of the outer surface) of each layer surrounding the conducting adhesive. In still other examples, the non-conducting adhesive may be used without the conducting adhesive, and exposed non-conducting inner surfaces of the at least partially aligned waveguide channels may be metallized. In yet still other examples, a fully adhered apparatus 200 with all the layers coupled together may be dipped into a solution so as to electroplate the apparatus 200, and, in addition to electroplating with the solution, selective areas of the apparatus 200 (e.g., the waveguide channels) may be metallized to improve conductivity. Other examples are also possible.

FIG. 2B illustrates an assembled view of the apparatus 200. After the layers are coupled together with the conducting adhesive and/or the non-conducting adhesive, a waveguide channel 212 may be formed through which electromagnetic waves may propagate. Further, the apparatus 200 shown in FIG. 2B may be coupled to other apparatuses similar to or different from the apparatus 200, so as to form a PWTL with an extended waveguide channel. In addition to the waveguide channel 212 shown in FIG. 2B, the apparatus 200 may include other waveguide channels (not shown) that are parallel to the waveguide channel 212 and orthogonal to each layer of the apparatus 200. In some examples, additionally or alternatively to the waveguide channel 212, the apparatus 200 may include waveguide channels that are non-orthogonal to each layer of the apparatus 200 (e.g., angled or zigzagged waveguide channels). Other examples are also possible. In general, the size and shape of the waveguide channels may be adjusted in order to tune performance (e.g., resonance characteristics, signal phases) of the PWTL. It should be understood that while each layer is described herein to include a hole (e.g., waveguide channel), such as a blind-hole, through-hole, or the like, one or more of the layers may not include a hole. Further, the apparatus 200 may be configured to radiate and/or propagate electromagnetic waves through layers that may not include any such hole.

Figure 2C:
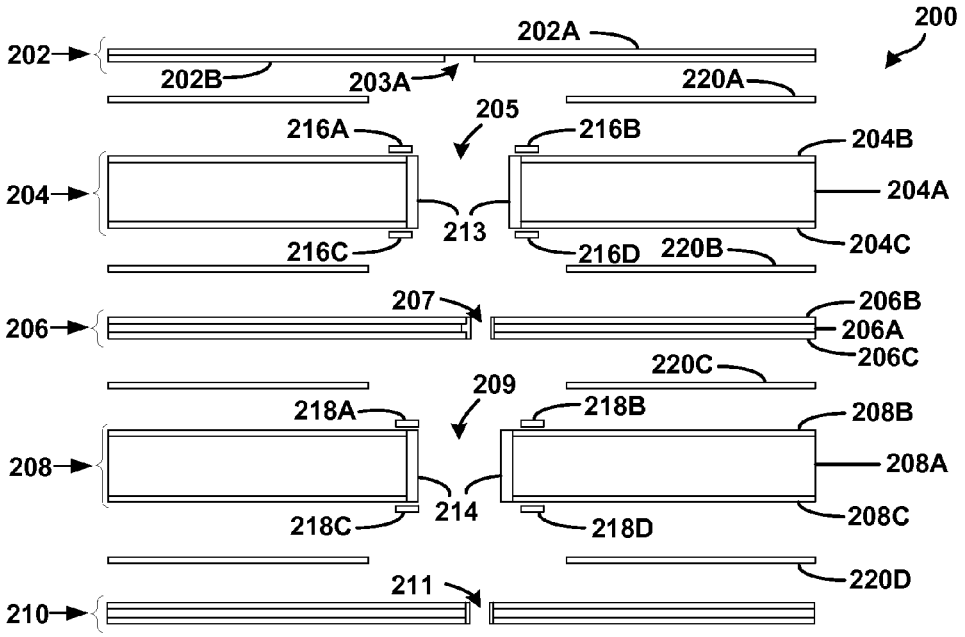
FIG. 2C illustrates an exploded view of a cross section of the example apparatus.

FIG. 2C illustrates an exploded view of a cross section of the example apparatus 200. FIG. 2C also illustrates layer details not shown in the FIGS. 2A and 2B in order to further illustrate the fabrication and characteristics of the apparatus 200.

As described above, the first layer 202 may be made of a Kapton layer coupled to a conducting layer (e.g., polyimide copper laminate), for example. In another example, the first layer 202 can be made of a conducting foil (e.g., a sheet of metal) that is not coupled to a dielectric layer. In FIG. 2C, the former example configuration is illustrated, where the first layer 202 includes a Kapton layer 202A and a conducting layer 202B coupled to the Kapton layer 202A. Kapton is used herein as an example, and other dielectric materials can be used in other examples. Similarly, the third layer 206 and the fifth layer 210 may also each include a metallic sheet or foil, or may each include a Kapton layer coupled to conducting layers. For example, the third layer 206 and the fifth layer 210 may be configured identically, and may include a Kapton layer 206A coupled to or laminated with two conducting layers (e.g., copper-clad laminates) 206B and 206C.

The first layer 202 may include a hole, such as a through-hole. As illustrated in FIG. 2C, however, the first layer 202 includes a blind-hole (e.g., a slot) 203A, as opposed to the through-hole 203 illustrated in FIG. 2A. In the example shown in FIG. 2C, the first layer 202 may function as an antenna screen element configured to enable the apparatus 200 to radiate radio waves through the blind-hole 203A of the first layer.

As described above and as illustrated in FIG. 2C, in some examples, the second layer 204 (and the fourth layer 208) may be made of dielectric material coupled to conducting layers (e.g., conducting sheet material). For instance, the second layer 204 may be composed of a dielectric layer (FR-4) 204A coupled to two conducting layers (e.g., sheets of copper laminates) 204B and 204C. Similarly, the fourth layer 208 may be composed of a dielectric layer (FR-4) 208A coupled to two conducting layers (e.g., sheets of copper laminates) 208B and 208C. Further, electric circuitry and traces and may be formed (e.g., imaged and etched using photolithography) on the two conducting layers of each of the second and fourth layers 204, 208 to implement electric circuits and associated functionality. In other examples, the second layer 204 and/or the fourth layer 208 may be made of conducting material (e.g., metallic material such as aluminum or copper), In still other examples, the second layer 204 and the fourth layer 208 may not be made of the same material. For example, the second layer 204 may be made of a conducting material such as aluminum, and the fourth layer 208 may be made of FR-4 material coupled to two laminating conducting layers, or vice versa. Similarly, the conducting layer 202B included in the first layer 202 may include material different from conducting materials used in other layers of the apparatus 200. Further, the first layer 202 may include material different from materials (e.g., conducting and non-conducting) used for the third layer 206 and/or the fifth layer 210. For instance, the first layer 202 may include only conducting material, while the third layer 206 and/or the fifth layer 210, may include a Kapton layer coupled between two laminating conducting layers. Other examples are also possible. In general, different combinations of material can be used for the different layers of the apparatus 200.

Regarding examples in which dielectric material is used to form the second layer 204, forming the through-hole 205 (e.g., waveguide channel) may expose non-conducting inner surfaces. In these examples, a metallic plating 213 or other thin metal surface may be provided (e.g., deposited) on respective inner surfaces of the through-hole 205 in the second layer 204. Similarly, regarding examples in which a dielectric material is used to form the fourth layer 208, forming the through-hole 209 in the fourth layer 208 may expose non-conducting inner surfaces. In these examples, a metallic plating 214 or other thin metal surface may be provided on respective inner surfaces of the through-hole 209 in the fourth layer 208. Further, the metallic material used to plate the through-hole/channel 205 of the second layer 204 may be of similar or different material than the metallic material used to plate the through-hole/channel 209 of the fourth layer 208. Other through-holes/channels in the apparatus 200 can also be plated if the layers in which the through-holes/channels are formed are made of dielectric materials.

FIG. 2C shows that the hole 203A of the first layer 202 may be aligned at least in part with the through-hole 205 of the second layer 204, and that the through-hole 205 of the second layer 204 may be aligned at least in part with the through-hole 207 of the third layer 206. In some examples, and as shown, the holes may be of different sizes (e.g., width, diameter, etc.). For instance, the through-hole 205 of the second layer 204 may be of a different size compared to respective sizes of the holes/through-holes of the first layer 202, third layer 206, fourth layer 208, and/or fifth layer 210. In general, one or more respective holes/channels of the apparatus 200 may be of the same or different size as another one or more respective holes/channels of the apparatus 200. The width of the waveguide channels may be adjusted (e.g., adjust metal plating thickness) in order to tune performance (e.g., resonance characteristics, signal phases) of the PWTL.

Having holes/through-holes of different sizes as depicted may help in tuning resonance characteristics in the electromagnetic waves propagating through respective signal interconnections or paths defined by respective holes/through-holes. As an example, the waveguide channel 207 of the third layer 206 that connects the waveguide channel 209 of the fourth layer 208 to the waveguide channel 205 of the second layer 204 may be referred to as an aperture, resonant slot, coupling channel, or slotted waveguide channel (SWGC). Dimensions of these holes/channels can be selected to tune resonance characteristics of the apparatus.

As described above, in some examples, a conducting adhesive such as solder paste may be applied to at least edges of the waveguide channels (e.g., surrounding the waveguide channels) so as to at least partially align the waveguide channels with each other and define an electromagnetic wave path through which electromagnetic waves (e.g., millimeter waves) may propagate. In other words, the conducting adhesive may couple waveguide channels together, such as the metal-plated through-holes 205, 209 of the second and fourth layers 204, 208, so as to form a longer waveguide channel comprising the shorter waveguide channels of each respective layer. For instance, conducting adhesive 216A, 216B, 216C, and 216D may be provided to at least the edges surrounding the plated waveguide channel 205 of the second layer 204 so as to couple the second layer 204 between the first layer 202 and the third layer 206, and conducting adhesive 218A, 218B, 218C, and 218D may be provided to at least the edges surrounding the plated waveguide channel 209 of the fourth layer 208 so as to couple the fourth layer 208 between the third layer 206 and the fifth layer 210. The conducting adhesive may provide sufficient adhesion for coupling each layer together.

Additionally or alternatively to the conducting adhesive, other adhesive layers, either conducting or non-conducting, may be positioned between respective layers of the apparatus 200 to couple the respective layers together. For instance, adhesive layer 220A can be positioned between the first layer 202 and the second layer 204, adhesive layer 220B can be positioned between the second layer 204 and the third layer 206, adhesive layer 220C can be positioned between the third layer 206 and the fourth layer 208, and adhesive layer 220D can be positioned between the fourth layer 208 and the fifth layer 210. In some examples, a subset of the adhesive layers 220A, 220B, 220C, and 220D may be used.

Figure 2D:
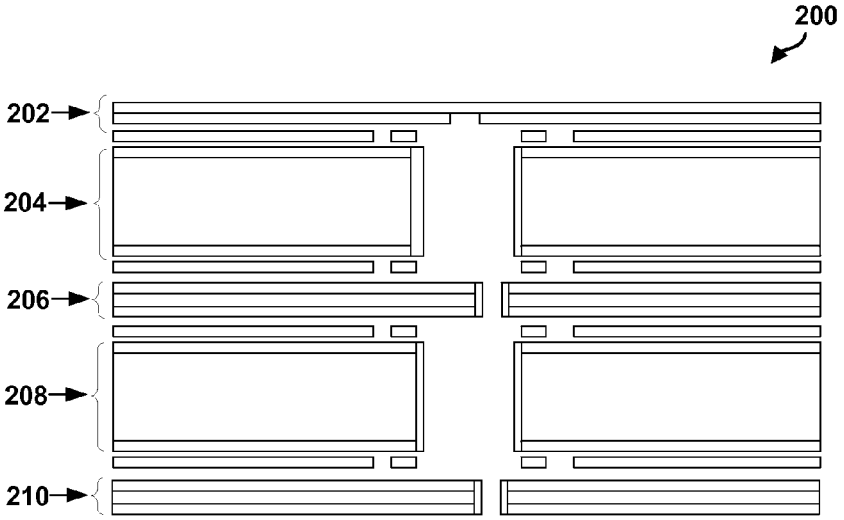
FIG. 2D illustrates an assembled view of the cross section of the example apparatus.

FIG. 2D illustrates an assembled view of the cross section of the apparatus 200. In some scenarios, pressure and heat can be applied to couple the layers of the apparatus 200 together. For instance, pressure and heat can be applied to one or both of the outermost layers of the apparatus 200 (i.e., the first layer 202 and the fifth layer 210) to couple or bind the respective layers together using the conducting adhesives 216A-216D, 218A-218D and/or the other adhesive layers 220A-220D between the respective layers. In some examples, the other adhesive layers 220A-220D may take the shape and size of the respective layers 202, 204, 206, 208, 210 that the other adhesive layers 220A-220D are coupled to. In other examples, such adhesive layers 220A-220D may take different shapes and sizes.

In some examples, pressure can be applied, by, for example, a plunger, on substantially an entire layer (e.g., the first layer 202 and/or the fifth layer 210) to couple the respective layers of the apparatus 200 together. The plunger, in these examples, may be referred to as a macro plunger. In other examples, an adhesive material or solder paste can be applied at discrete locations between the respective layers of the apparatus 200 as depicted by the conducting adhesives 216A-216D or 218A-218D shown in FIG. 2C. In these examples, a plunger can be used to apply pressure at the discrete locations. In this case, the plunger may be referred to as a micro plunger. The non-conducting adhesive material can be any type of adhesive appropriate for the material of the respective layers of the apparatus 200. As an example, the adhesive can include polymerizable material that can be cured to bond the layers together. Curing involves the hardening of a polymer material by cross-linking of polymer chains, and curing may be, for example, brought about by chemical additives, ultraviolet radiation, electron beam, and/or heat. In an example, the polymerizable material may be made of a light-curable polymer material that can be cured using ultraviolet (UV) light or visible light. In addition to light curing, other methods of curing are possible as well, such as chemical additives and/or heat. Any other type of adhesive and bonding method can be used to couple the respective layers of the apparatus 300 together.

It should be understood that additional layers, similar or different than the layers described herein, may be coupled to the apparatus 200 shown in FIGS. 2C and 2D. By adding more layers to the apparatus 200, a complex network of 3D interconnections can be created to receive and transmit electromagnetic waves. Such a network of 3D interconnections can be implemented in complex electromagnetic systems. For example, radars include complex mechanical, electronic, and electromagnetic systems. Radar systems may include different subsystems. These subsystems may be composed of different components. For instance, a radar antenna may be configured to act as an interface between the radar system and free space through which radio waves may be transmitted and received. The antenna may be configured to transduce free space propagation to guided wave propagation during reception and the opposite during transmission. During transmission, the radiated energy may be concentrated into a shaped beam which points in a desired direction in space. During reception, the antenna collects the energy contained in the echo signal and delivers it to a receiver. The antenna and all or a subset of associated components of the radar system may be integrated into a functional unit by stacking layers as described with respect to FIGS. 2A, 2B, 2C, and 2D to form a network of 3D electromagnetic signal interconnections to implement functionality of the different components of the radar system.

Figure 3:
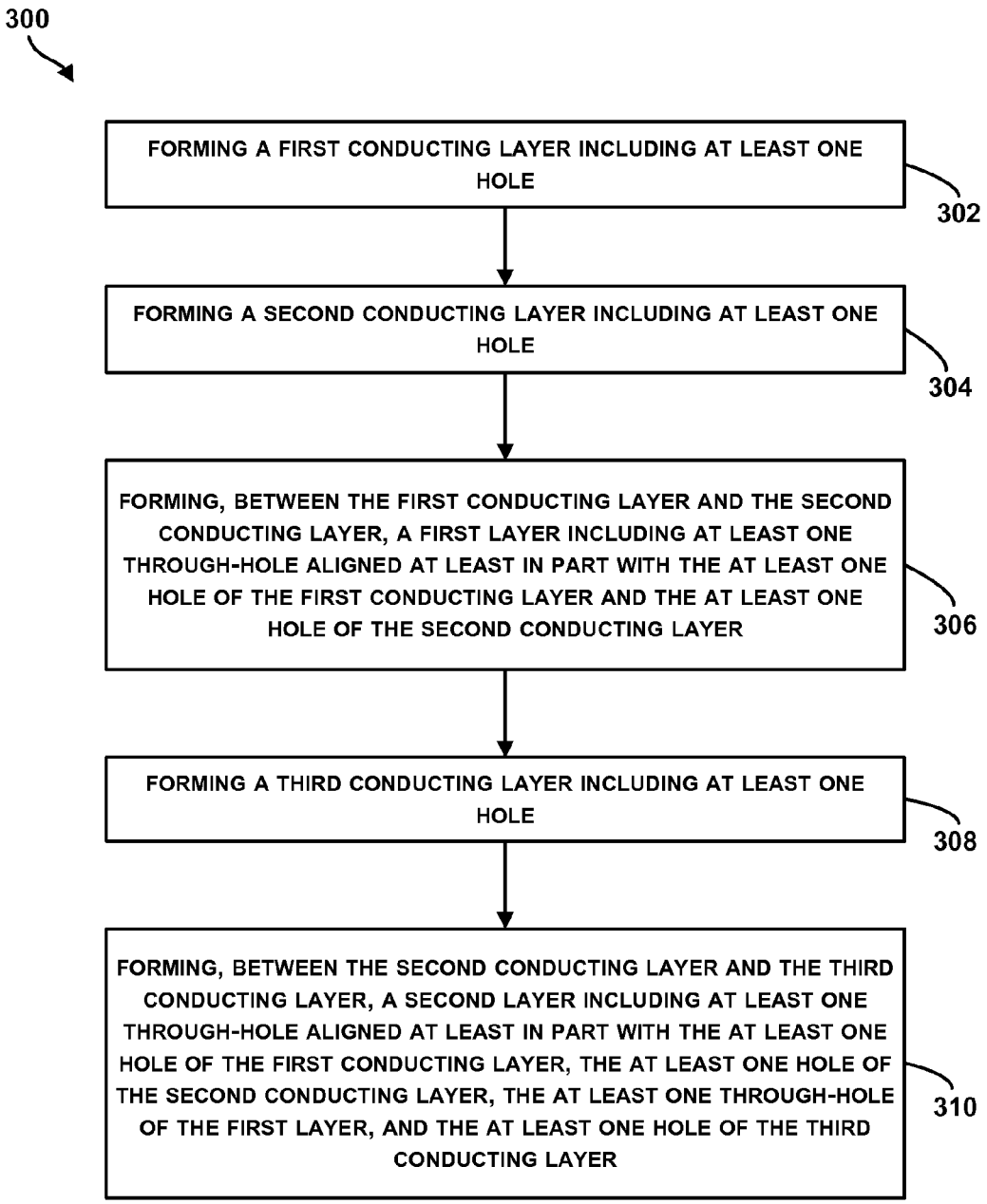
FIG. 3 is a flow chart of another method to form 3D signal interconnections using PWTLs, in accordance with an example embodiment.

FIG. 3 is a flow chart of another method 300 to form 3D signal interconnections using a PWTL. The PWTL, such as that described by the method 300, may be fabricated using components such as conducting layers, metal layers, and dielectric laminate layers. It should be understood that other methods of fabrication are also possible.

The method 300 may include one or more operations, functions, or actions as illustrated by one or more of blocks 302, 304, 306, 308, and 310. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

At block 302, the method 300 includes forming a first conducting layer including at least one hole. As noted above, the first conducting layer may, for example, be made of a foil or sheet metal, and may include copper, aluminum, or any other conducting materials. In some examples, the first conducting layer may include a Kapton layer or other laminate coupled to the first conducting layer. In other examples, another conducting copper layer may be coupled to the Kapton layer from the other side of the Kapton layer such that the Kapton layer is sandwiched between two conducting layers. In general, it should be understood that one or more aspects of the first conducting layer may be similar to aspects described above with respect to layer 202 of FIG. 2A.

At block 304, the method 300 includes forming a second conducting layer including at least one hole. It should be understood that one or more aspects of the second conducting layer may be similar to aspects of the first conducting layer just described, and/or to aspects described above with respect to layer 206 of FIG. 2A.

At block 306, the method 300 includes forming, between the first conducting layer and the second conducting layer, a first layer including at least one through-hole aligned at least in part with the at least one hole of the first conducting layer and the at least one hole of the second conducting layer. In some examples, the first layer may include a metal layer, such as aluminum or a layer made of one or more metallic materials. In such examples, because the inner surface of the at least one through-hole is a conducting surface, there may be no need to plate or otherwise metallize the at least one through-hole so as to form a waveguide channel. Further, in such examples, the first layer may be coupled directly between two layers of foil or sheet metal (e.g., the first and second conducting layers). The first layer, first conducting layer, and second conducting layer may be coupled using conducting adhesive and/or non-conducting adhesive as described above. In other examples, the first layer may include a dielectric layer coupled between two conducting layers (e.g., a PCB). It should be understood that one or more aspects of the first layer may be similar to aspects described above with respect to layer 204 of FIG. 2A.

At block 308, the method 300 includes forming a third conducting layer including at least one hole. It should be understood that one or more aspects of the second conducting layer may be similar to aspects of the first conducting layer and/or second conducting layer just described, and/or to aspects described above with respect to layer 210 of FIG. 2A.

At block 310, the method 300 includes forming, between the second conducting layer and the third conducting layer, a second layer including at least one through-hole aligned at least in part with the at least one hole of the first conducting layer, the at least one hole of the second conducting layer, the at least one through-hole of the first layer, and the at least one hole of the third conducting layer. It should be understood that one or more aspects of the second layer may be similar to aspects of the first layer just described, and/or to aspects described above with respect to layer 208 of FIG. 2A. Further, all layers described with respect to method 300 may be coupled/adhered using conducting adhesives, non-conducting adhesives, and/or other adhesives and adhesion methods not described herein. Still further, the holes/through-holes of each layer may be aligned at least in part with each other so as to form a waveguide channel configured to transmit millimeter electromagnetic waves.

Examples described herein of building a network of 3D interconnections based on layers as described above can also be used in microwave ovens, satellite communications, high speed routers and cabling, and antenna systems, among others. A given application may determine appropriate dimensions and sizes for the through-holes and waveguide channels. For instance, some example radar systems may be configured to operate at an electromagnetic wave frequency of 77 Giga-Hertz (GHz), which corresponds to millimeter (mm) electromagnetic wave length. At this frequency, the through-holes and the waveguide channels of the apparatus 200 (e.g., an apparatus fabricated by way of method 100 or method 300) may be of given dimensions appropriated for the 77 GHz frequency. For an application operating at a frequency that is an order of magnitude lower than the 77 GHz frequency, respective dimensions of the through-holes and the waveguide channels of the apparatus 200 may be an order of magnitude larger. Other examples are possible.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

While various aspects and embodiments have been disclosed herein, other aspects and embodiments will be apparent to those skilled in the art. The various aspects and embodiments disclosed herein are for purposes of illustration and are not intended to be limiting, with the scope being indicated by the following claims.

What is claimed is:

1. An apparatus for a waveguide transmission line, the apparatus comprising:

a first layer comprising at least one first conducting layer coupled to a first dielectric layer;

a second layer coupled to the first layer and comprising a second dielectric layer coupled between a second conducting layer and a third conducting layer, wherein the second layer includes at least one through-hole;

a third layer coupled to the second layer and comprising a third dielectric layer coupled between a fourth conducting layer and a fifth conducting layer, wherein the third layer includes at least one through-hole aligned at least in part with the at least one through-hole of the second layer;

a fourth layer coupled to the third layer and comprising a fourth dielectric layer coupled between a sixth conducting layer and a seventh conducting layer, wherein the fourth layer includes at least one through-hole aligned at least in part with the at least one through-holes of the second and third layers;

a fifth layer coupled to the fourth layer and comprising a fifth dielectric coupled between an eighth conducting layer and a ninth conducting layer, wherein the fifth layer includes at least one through-hole aligned at least in part with the at least one through-holes of the second, third, and fourth layers;

a conducting adhesive coupled to at least edges of the at least one through-hole of the second layer, wherein the conducting adhesive is configured to couple the second layer between the first layer and the third layer so as to align at least in part the at least one through-hole of the second layer with the at least one through-holes of the first layer and the third layer; and a conducting adhesive coupled to at least edges of the at least one through-hole of the fourth layer, wherein the conducting adhesive is configured to couple the fourth layer between the third layer and the fifth layer so as to align at least in part the at least one through-hole of the fourth layer with the at least one through-holes of the third layer and the fifth layer.

2. The apparatus of claim 1, wherein the first layer includes at least one hole, wherein the at least one hole includes either a blind-hole formed less than entirely through the first layer or a through-hole formed entirely through the first layer, and wherein the first layer further includes an antenna screen element configured to enable the apparatus to radiate radio waves through the at least one hole of the first layer.

3. The apparatus of claim 1, wherein the at least one through-holes of the second, third, fourth, and fifth layers are substantially aligned so as to form a waveguide channel configured to transmit millimeter electromagnetic waves.

4. The apparatus of claim 1, wherein the second layer and fourth layer each include a printed circuit board (PCB).

5. The apparatus of claim 1, wherein the first, third, and fifth layers of the apparatus include a polyimide copper laminate.

6. The apparatus of claim 1, wherein each of the through-holes of the second layer, the third layer, the fourth layer, and the fifth layer are configured through the second, third, fourth, and fifth dielectric layers, respectively, and wherein each of the through-holes of the respective dielectric layers includes a plated through-hole, wherein the plated through-hole includes metal plating coupled to at least an inner surface of the through-hole of the dielectric layer.

7. The apparatus of claim 1, wherein the first layer is coupled to the second layer with a first adhesive layer, the second layer is coupled to the third layer with a second adhesive layer, the third layer is coupled to the fourth layer with a third adhesive layer, and the fourth layer is coupled to the fifth layer with a fourth adhesive layer.

8. The apparatus of claim 1, wherein at least one through-hole of the second layer and the fourth layer includes a through-hole of greater width than the at least one through-hole of the third layer and the fifth layer.

9. A method, comprising:

forming at least one waveguide channel of a first shape in a first layer, wherein the first layer includes a first dielectric layer coupled to one or more of a first conducting layer and a second conducting layer;

forming at least one waveguide channel of a second shape in a second layer, wherein the second layer includes a second dielectric layer coupled between a third conducting layer and a fourth conducting layer;

providing a first metal plating to an inner surface of the at least one waveguide channel of the second shape;

forming at least one waveguide channel of a third shape in a third layer, wherein the third layer includes a third dielectric layer coupled to one or more of a fifth conducting layer and a sixth conducting layer;

providing a second metal plating to an inner surface of the at least one waveguide channel of the third shape; and providing a conducting adhesive to at least edges of the at least one waveguide channel in the second layer, wherein the conducting adhesive is configured to couple the second layer between the first layer and the third layer so as to align at least in part the at least one waveguide channel of the second layer with the at least one waveguide channels of the first layer and the third layer.

10. The method of claim 9, wherein the at least one waveguide channel of the first shape includes a through-hole of the first shape, the method further comprising:

providing a metal plating to an inner surface of the through-hole of the first shape.

11. The method of claim 9, further comprising:

providing an adhesive layer to one or more of an outer surface of the second layer and an opposite outer surface of the second layer, wherein the adhesive layer is configured to couple the second layer between the first layer and the third layer so as to align at least in part the at least one waveguide channel of the second layer with the at least one waveguide channels of the first layer and the third layer, and wherein the adhesive layer is provided to at least one outer surface of the second layer surrounding the conducting adhesive.

12. The method of claim 9, further comprising:

forming at least one waveguide channel of a fourth shape in a fourth layer, wherein the fourth layer includes a fourth dielectric layer coupled between a seventh conducting layer and an eighth conducting layer;

providing a third metal plating to an inner surface of the at least one waveguide channel of the fourth shape;

forming at least one waveguide channel of a fifth shape in a fifth layer, wherein the fifth layer includes a fifth dielectric layer coupled between a ninth conducting layer and a tenth conducting layer;

providing a fourth metal plating to an inner surface of the at least one waveguide channel of the fifth shape;

providing a conducting adhesive to at least edges of the at least one waveguide channel in the fourth layer, wherein the conducting adhesive is configured to couple the fourth layer between the third layer and the fifth layer so as to align at least in part the at least one waveguide channel of the fourth layer with the at least one waveguide channels of the third layer and the fifth layer; and providing an adhesive layer to at least one outer surface of the fourth surrounding the conducting adhesive, wherein the adhesive layer is configured to couple the fourth layer between the third layer and the fifth layer so as to align at least in part the at least one waveguide channel of the fourth layer with the at least one waveguide channels of the third layer and the fifth layer.

13. The method of claim 9, wherein the first dielectric layer includes an antenna screen element configured to enable the first layer to radiate millimeter electromagnetic waves through the at least one waveguide channel in the first layer, and wherein the at least one channels of the second layer and the third layer are aligned so as to enable the at least one waveguide channels of the second layer and the third layer to transmit the millimeter electromagnetic waves.

14. The method of claim 9, wherein one or more of the first shape, the second shape, and the third shape are the same shape.

15. A method, comprising:

forming a first conducting layer including at least one hole;

forming a second conducting layer including at least one hole;

forming, between the first conducting layer and the second conducting layer, a first layer including at least one through-hole, wherein the at least one through-hole of the first layer is aligned at least in part with the at least one hole of the first conducting layer and the at least one hole of the second conducting layer;

forming a third conducting layer including at least one hole;

forming, between the second conducting layer and the third conducting layer, a second layer including at least one through-hole, wherein the at least one through-hole of the second layer is aligned at least in part with the at least one hole of the first conducting layer, the at least one hole of the second conducting layer, the at least one through-hole of the first layer, and the at least one hole of the third conducting layer; and providing at least one respective adhesive layer between one or more of:

the first conducting layer and the first layer, the first layer and the second conducting layer, the second conducting layer and the second layer, and the second layer and the third conducting layer, wherein the at least one respective adhesive layer includes one or more of a conducting adhesive layer and a non-conducting adhesive layer.

16. The method of claim 15, wherein the at least one hole of the first conducting layer, the at least one hole of the second conducting layer, the at least one through-hole of the first layer, the at least one hole of the third conducting layer, and the at least one through-hole of the second layer are at aligned at least in part with each other so as to form a waveguide channel configured to transmit millimeter electromagnetic waves.

17. The method of claim 15, wherein each of the first layer and the second layer include a metal layer.

18. The method of claim 15, wherein one or more of the first, second, and third conducting layers includes a dielectric layer.

* * * * *